US007310988B2

(12) United States Patent
Kanamaru et al.

(10) Patent No.: US 7,310,988 B2
(45) Date of Patent: Dec. 25, 2007

(54) DRIVE DEVICE FOR A MECHANICAL PRESS

(75) Inventors: Hisanobu Kanamaru, Sagamihara (JP); Takao Ito, Kanagawa (JP)

(73) Assignee: AIDA Engineering Co., Ltd., Kanagawa (JP)

( * ) Notice: Subject to any disclaimer, the term of this patent is extended or adjusted under 35 U.S.C. 154(b) by 202 days.

(21) Appl. No.: 10/613,523

(22) Filed: Jul. 2, 2003

(65) Prior Publication Data

US 2004/0050262 A1 Mar. 18, 2004

(30) Foreign Application Priority Data

Jul. 10, 2002 (JP) ..... 2002-201213

(51) Int. Cl.
*B21J 9/18* (2006.01)
*B30B 1/26* (2006.01)

(52) U.S. Cl. ..... 72/449; 100/280; 100/282; 72/455; 192/12 R; 192/144

(58) Field of Classification Search ..... 100/44, 100/85, 99, 100, 131–135, 147–149, 47–51, 100/220, 256–257, 260, 208–209, 280, 282, 100/214, 273; 72/455; 192/12 R, 144
See application file for complete search history.

(56) References Cited

U.S. PATENT DOCUMENTS

| | | | | |
|---|---|---|---|---|
| 4,607,732 | A * | 8/1986 | Ikeoka et al. | 192/12 R |
| 4,625,850 | A * | 12/1986 | Marsh | 192/143 |
| 5,158,047 | A * | 10/1992 | Schaal et al. | 123/78 BA |
| 6,301,986 | B1 * | 10/2001 | Berky | 74/410 |

FOREIGN PATENT DOCUMENTS

| | | | |
|---|---|---|---|
| DE | 100 43 007 | A1 | 3/2002 |
| EP | 1 075 931 | A2 | 2/2001 |
| GB | 2 258 186 | A1 | 2/1993 |
| JP | 61-092800 | A1 | 5/1986 |
| JP | 06-063799 | | 3/1994 |
| JP | 06-155099 | | 6/1994 |
| JP | 09-174289 | A1 | 7/1997 |
| JP | 10-314996 | | 12/1998 |
| JP | 11-033797 | | 2/1999 |
| JP | 11-090691 | A1 | 4/1999 |

OTHER PUBLICATIONS

Patent Abstracts of Japan for JP06-063799 published on Mar. 8, 1994.
Patent Abstracts of Japan for JP11-033797 published on Feb. 9, 1999.
Patent Abstracts of Japan for JP06-155099 published on Jun. 3, 1994.
Patent Abstracts of Japan for JP10-314996 published on Dec. 2, 1998.
English Abstract of EP 1075931A2.
Examination Report from the European Patent Office dated Jan. 3, 2006.

* cited by examiner

*Primary Examiner*—David B Jones
(74) *Attorney, Agent, or Firm*—Darby & Darby P.C.

(57) ABSTRACT

The invention provides a drive device for a mechanical press with a two-step speed reduction mechanism for driving a slide of the mechanical press and includes a drive pinion provided concentrically with a crankshaft, a main gear mounted on said crankshaft, intermediate gears meshing with the drive pinion, and intermediate pinions meshing with the main gear. A plurality of the intermediate gears and the intermediate pinions are provided concentrically with each other. An intermediate gear that meshes with the drive pinion is arranged concentric with an intermediate pinion that meshes with a main gear. This drive device provides a more compact mechanical press.

17 Claims, 3 Drawing Sheets

DRIVE DEVICE FOR A MECHANICAL PRESS

BACKGROUND OF THE INVENTION

1. Field of the Invention

The present invention is related to a drive device of a mechanical press. The mechanical press is a two-step speed reduction, one point mechanical press.

2. Description of the Related Art

In a plastic forming process, it is essential that the workpiece is formed at a proper forming speed, so that it is necessary to adjust the downward speed of the slide in accordance with the process. Therefore, a speed reducing mechanism is built into the drive device that drives the slide up and down. The reduction mechanism is normally designed as a single-step reduction of a two-step reduction unit.

Examples of single-step reduction mechanism are disclosed in Unexamined Publication of Patent Application H06-063799 and H11-33797, while examples of two-step reduction mechanism are disclosed in Unexamined Publication of Patent Application H06-155099 and H10-314996. The titles and part numbers used in the following descriptions are according to these publications.

Unexamined Publication of Patent Application H06-063799 shows a mechanical press of one point type with a single connecting rod, having a single-stage reduction mechanism. The drawing shows a flywheel 4 being driven rotationally by means of a motor 2 and a belt 3. A pinion gear 6 is provided on a transmission shaft 5 of flywheel 4 and a main gear 7 is provided on a crankshaft 8, wherein pinion gear 6 meshes with main gear 7. Crankshaft 8 and connecting rod 9 constitute a crank mechanism and a slide 10 is driven up and down by said crank mechanism.

Speed reduction is accomplished by means of said pinion gear 6 and main gear 7. In other words, H06-063799 is a mechanical press with a single-step speed reduction mechanism consisting of pinion gear 6 and main gear 7.

Unexamined Publication of Patent Application H11-33797 also shows a mechanical press of one point type with a single-stage speed reduction mechanism. In FIG. 1, a pinion gear 8 meshes with a main gear 9.

Unexamined Publication of Patent Application H06-155099 shows a mechanical press of two point type with a two-step speed reduction mechanism. In FIG. 2, a gear train 8*c* constitutes a one-step speed reducing mechanism and addition of a main gear 8*b* makes it a two-step speed reducing mechanism. A connecting rod 8*e* engages with an eccentric part 8*d* provided on main gear 8*b* thus constituting a so-called "crankless" mechanism. Despite its name of "crankless," it is essentially a crank mechanism and a slide 7 moves up and down with the help of this crank mechanism.

In the figure of said Unexamined Publication of Patent Application H10-314996, a drive gear 17 and a right intermediate gear 16A constitute a first-step speed reduction mechanism, while a right pinion gear 15A and a right main gear 13A constitute a second-step speed reduction mechanism.

In all of the abovementioned single-step speed reduction or two-step speed reduction mechanisms, a pair of a small gear (pinion gear, etc.) and a large gear (main gear, etc.) are meshing. In all of these speed reduction mechanisms, the main gear tends to be too large, making it difficult to make the entire mechanical press more compact.

SUMMARY OF THE INVENTION

The structure provided by the present invention is to arrange a drive pinion to be concentric with crankshaft, and to arrange an intermediate gear that meshes with the drive pinion to be concentric with an intermediate pinion that meshes with a main gear. More specifically, the invention of claim 1 provides a drive device for a mechanical press with a two-step speed reduction mechanism for driving a slide of the mechanical press comprising: a drive pinion provided concentrically with a crankshaft; a main gear mounted on said crankshaft; intermediate gears meshing with said drive pinion; and intermediate pinions meshing with said main gear; wherein a plurality of said intermediate gears and said intermediate pinions are concentrically provided with each other.

The invention of claim 2 has such a feature, in addition to the constitution described in claim 1, that said intermediate gears and said intermediate pinions are provided two pieces each, said intermediate gears are located on both sides of said drive pinion on symmetric positions, while said intermediate pinions are located on both sides of said main gear on symmetric positions. The invention of claim 3 has such a feature, in addition to the constitution described in claim 1 or claim 2, that one end of a drive shaft, on which said drive pinion is provided, is made to engage with a hole formed on an end of said crankshaft rotatably in order to support said end of the drive shaft.

The invention of claim 4 provides a drive device for a mechanical press with a two-step speed reduction mechanism for driving a slide of the mechanical press comprising: a drive pinion provided concentrically with a crankshaft; a main gear mounted on said crankshaft; intermediate gears meshing with said drive pinion; and intermediate pinions meshing with said main gear; wherein a plurality of said intermediate gears and said intermediate pinions are concentrically provided with each other; and further comprising with a brake provided on a machine frame and a brake pinion formed on said brake shaft.

The invention makes it possible to reduce the diameter of main gear 11 smaller thus making it possible to design the mechanical press more compact. Moreover, since it is possible to arrange a plurality of gears in such a way as to cancel out the multiple tangential forces applied on main gear 11 and drive pinion 7 that mesh with the plurality of gears, the loads on the bearings can be reduced.

PREFERRED EMBODIMENT OF THE INVENTION

Figure 1:
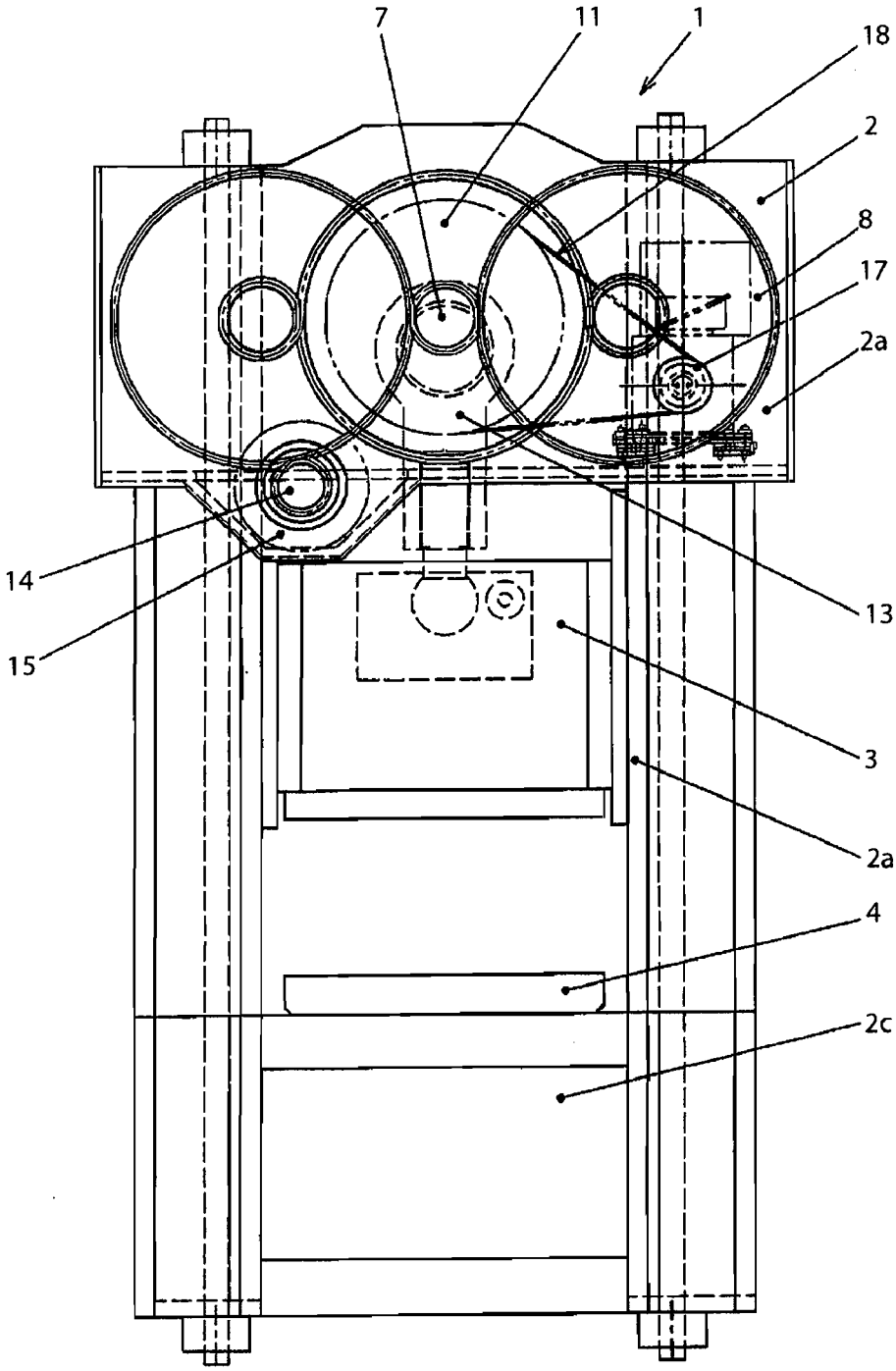
FIG. 1 is a front view and a partial cross section of the present invention.
Figure 2:
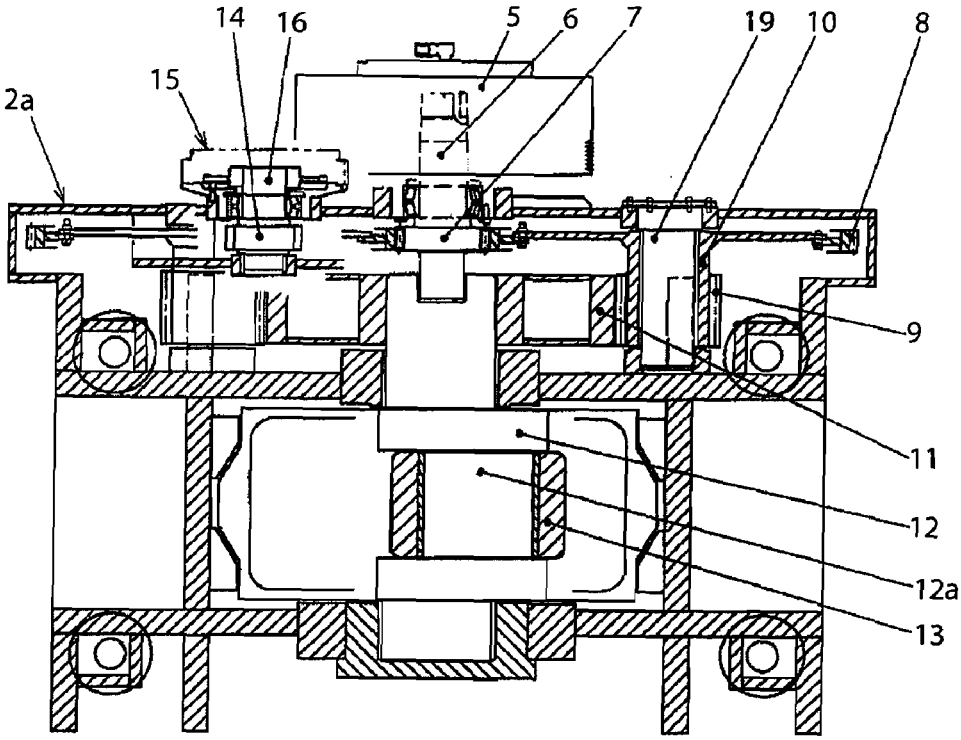
FIG. 2 is a top view and a partial cross section.
Figure 3:
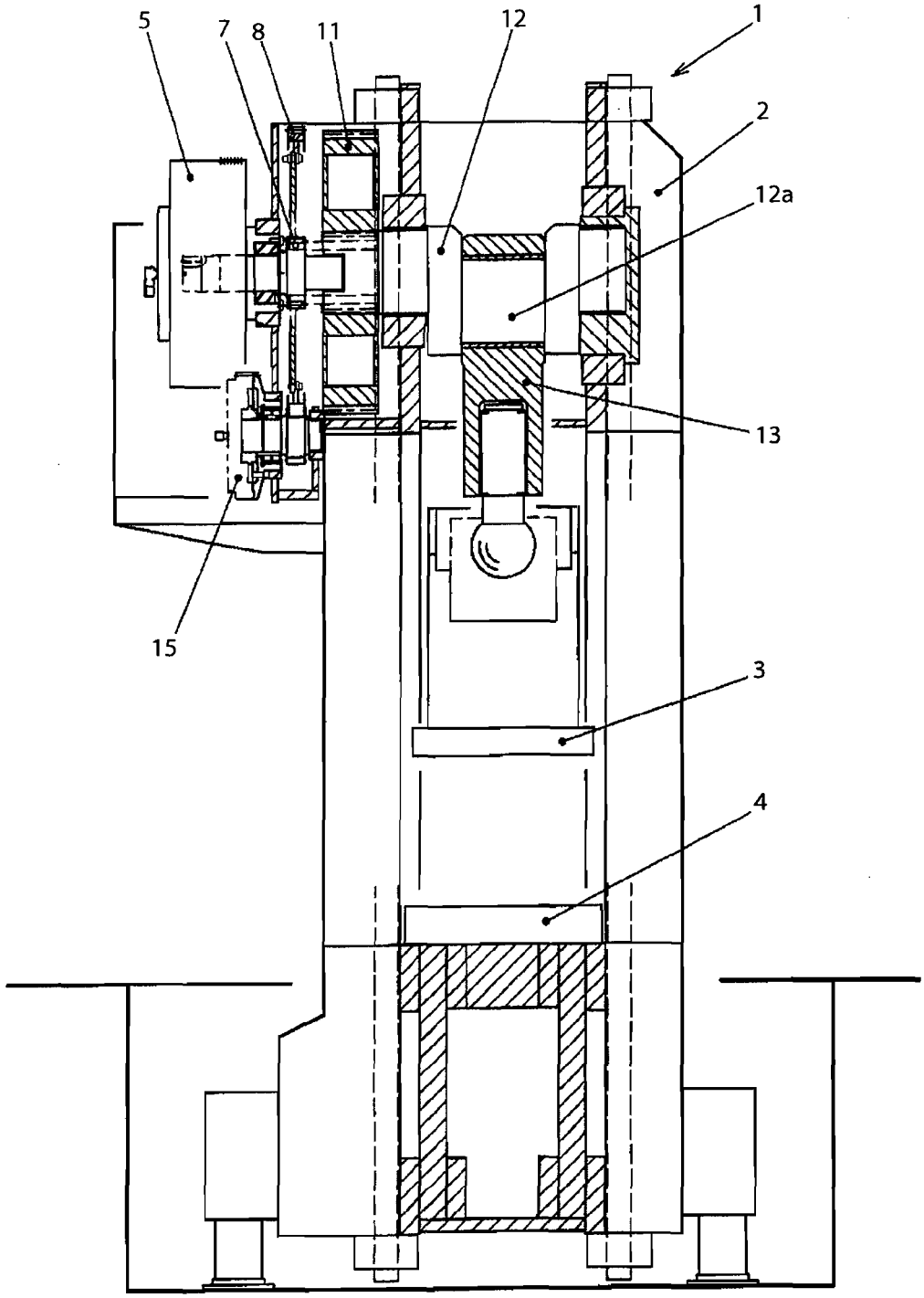
FIG. 3 is a left side view on a partial cross section.

In FIGS. 1 to 3, a mechanical press 1 consists of a frame 2 and various members built into it. Frame 2 comprises a crown 2*a*, a column 2*b* and a bed 2*c*, all of which are tied together to form a singe unit by means of tie rods. Crown 2*a* contains drive members for driving a slide 3 up and down.

Column 2*b* has guides for guiding slide 3 up and down. Bed 2*c* has a bolster 4 provided in a position opposing slide 3. A upper die (not shown) is fastened to the bottom surface of slide 3 and a lower die (not shown) is fastened to the top surface of bolster 4, whereas the material supplied between these top and bottom dies is press formed as slide 3 moves up and down.

A crankshaft 12 is supported rotatably by bearings in crown 2*a*. An eccentric part 12*a* of crankshaft 12 engages with a hole formed in the upper part of a connecting rod 13. The lower end of connecting rod 13 is connected to slide 3. Crank shaft 12 and connecting rod 13 constitute a crank mechanism. Slide 3 moves up and down driven by a crank mechanism.

A flywheel 5 is provided rotatably in crown 2*a*. Flywheel 5 is driven by a motor 17 and a belt 18. A clutch is built into flywheel 5. These structures are identical to those of the prior art.

A drive shaft 6 is provided penetrating through flywheel 5 to transmit the rotating force and is supported rotatably by means of bearings provided in crown 2*a* and a hole provided an end of said crankshaft 12. Drive shaft 6 is provided with a drive pinion 7. In this embodiment, drive pinion 7 is formed integral with drive shaft 6. It is also possible to make drive pinion 7 separately and fasten it on drive shaft 6.

An intermediate shaft 10 is provided to rotate freely in crown 2*a*. Intermediate shaft 10 is supported rotatably by pin 19, which is affixed to crown 2*a*. Intermediate shaft 10 is provided with an intermediate gear 8 and an intermediate pinion 9. Intermediate gear 8 meshes with said drive pinion 7. In this embodiment, intermediate gear 8 is affixed to an intermediate shaft 10 with a reamer bolt, while intermediate pinion 9 is formed integral with intermediate shaft 10. In some cases, intermediate shaft 10 and both gears can be formed integrally or can be made separately to be affixed with reamer bolts.

Main gear 11 is affixed to crankshaft 12. In other words, crankshaft 12 and main gear 11 are made to rotate together. Main gear 11 is meshing with said intermediate pinion 9.

A brake 15 is provided on crown 2*a*. A brake shaft 16 that penetrates through brake 15 and transmits the rotating power is supported rotatably by bearings provided in crown 2*a*. Brake 16 has a braking pinion 14 formed on it. Braking pinion 14 meshes with said intermediate gear 8. The necessary braking torque can be reduced by making braking pinion 14 smaller. Although brake 15 is provided separately from the clutch in this embodiment, it is possible to combine the clutch and the brake to form a combined type clutch-brake unit to be installed in flywheel 5 if there is no need to make the brake torque smaller.

In this embodiment, two pieces each of said intermediate gears 8 and intermediate pinions 9 are provided. Intermediate gears 8, 8 are provided on the symmetric positions on both sides of drive pinion 7. Intermediate gear 8 and intermediate pinion 9 are provided coaxially. Intermediate pinions 9 are provided on the symmetric positions on both sides of main gear 11.

Since the rotating power is transmitted by two intermediate pinions 9, 9, the transmitted torque is twice as large as the torque in case only one intermediate pinion 9 is used. Thus, to transmit the same torque, the diameter of main gear 11 can be halved. For the same reason, either the diameter of drive pinion 7 can be reduced to one half or the clutch torque can be halved. If the diameter is maintained the same, the width can be halved.

Although the numbers of intermediate gears 8 and intermediate pinions 9 are two each, these numbers can be arbitrarily increased. In other words, arbitrary sets of intermediate gears 8 and intermediate pinions 9 can be used as needed.

When the clutch is turned on and brake 15 is turned off, the rotating power of flywheel 5 is transmitted to drive pinion 7, intermediate gears 8, intermediate pinions 9, main gear 11, and crank shaft 12, then the rotating power is converted to reciprocating force by means of the crank mechanism to be transmitted to the slide. Thus slide 3 moves up and down.

What is claimed is:

1. A drive device for a mechanical press with a two-step speed reduction mechanism for driving a slide of the mechanical press comprising:

a drive pinion provided concentrically with a crankshaft;

a main gear mounted on said crankshaft;

intermediate gears meshing with said drive pinion;

intermediate pinions meshing with said main gear; and a drive shaft connected to said drive pinion;

wherein a plurality of said intermediate gears and said intermediate pinions are concentrically provided with each other, and said drive shaft and said crankshaft rotate about a common axis.

2. A drive device for a mechanical press described in claim 1, further comprising:

a second set of intermediate gears, wherein said intermediate gears and said second set of intermediate gears are located on opposite sides of said drive pinion in symmetric positions; and a second set of intermediate pinions, wherein said intermediate pinions and said second set of intermediate pinions are located on opposite sides of said main gear on symmetric positions.

3. A drive device for a mechanical press described in claim 1, wherein said drive shaft includes an end on which said drive pinion is provided, and said drive shaft rotatably engages a hole formed on an end of said crankshaft in order to support another end of the drive shaft.

4. A drive device for a mechanical press described in claim 2, wherein said drive shaft includes an end on which said drive pinion is provided, and said drive shaft rotatably engages a hole formed on an end of said crankshaft in order to support another end of the drive shaft.

5. The drive device for a mechanical press described in claim 1, further comprising:

a brake comprising:

a brake shaft; and a brake pinion formed on said brake shaft and meshing with said intermediate gears, wherein a plurality of said intermediate gears and said intermediate pinions are concentrically provided with each other.

6. A drive device for a mechanical press described in claim 5, further comprising:

a second set of intermediate gears, wherein said intermediate gears and said second set of intermediate gears are located on opposite sides of said drive pinion in symmetric positions; and a second set of intermediate pinions, wherein said intermediate pinions and said second set of intermediate pinions are located on opposite sides of said main gear on symmetric positions.

7. A drive device for a mechanical press described in claim 6, further comprising:

a drive shaft having an end on which said drive pinion is provided, said drive shaft rotatably engages a hole formed on an end of said crankshaft in order to support another end of the drive shaft.

8. A drive device for a mechanical press described in claim 5, further comprising a flywheel transmitting rotational motion to said drive pinion, wherein said drive shaft penetrates through said flywheel and said main gear.

9. A drive device for a mechanical press described in claim 5, further comprising a single flywheel transmitting rotational motion to said drive pinion, wherein said drive shaft penetrates through said flywheel.

10. A drive device for a mechanical press described in claim 5, further comprising:

a drive shaft having an end on which said drive pinion is provided, said drive shaft rotatably engages a hole formed on an end of said crankshaft in order to support another end of the drive shaft.

11. A drive device for a mechanical press described in claim 1, further comprising a flywheel transmitting rotational motion to said drive pinion, wherein said drive shaft penetrates through said flywheel and said main gear.

12. A drive device for a mechanical press described in claim 1, further comprising a single flywheel transmitting rotational motion to said drive pinion, wherein said drive shaft penetrates through said flywheel.

13. A drive device for a mechanical press with a two-step speed reduction mechanism for driving a slide of the mechanical press comprising:

a drive pinion provided concentrically with a crankshaft;

a main gear mounted on said crankshaft;

intermediate gears meshing with said drive pinion;

intermediate pinions meshing with said main gear; and a drive shaft connected to said drive pinion, wherein a plurality of said intermediate gears and said intermediate pinions are concentrically provided with each other, the intermediate gears are symmetric to each other about a vertical plane, and said drive shaft and said crankshaft rotate about a common axis.

14. A drive device for a mechanical press described in claim 13, wherein the vertical plane intersects the drive pinion.

15. A drive device for a mechanical press with a two-step speed reduction mechanism for driving a slide of the mechanical press comprising:

a crankshaft;

a drive pinion provided concentrically with the crankshaft;

a main gear mounted on the crankshaft;

intermediate gears meshing with the drive pinion;

intermediate pinions meshing with the main gear; and a drive shaft connected to the drive pinion;

an axis of rotation;

wherein a plurality of the intermediate gears and the intermediate pinions are concentrically provided with each other, and the drive shaft and the crankshaft rotate around about the axis of rotation.

16. A drive device for a mechanical press as described in claim 15, wherein the drive shaft, the crankshaft, and the drive pinion rotate about the axis of rotation.

17. A drive device for a mechanical press as described in claim 15, wherein the axis of rotation is a horizontal axis as viewed from an upright position of the press.

* * * * *